US008886065B2

(12) United States Patent
Kondo

(10) Patent No.: US 8,886,065 B2
(45) Date of Patent: Nov. 11, 2014

(54) IMAGE FORMING APPARATUS

(71) Applicant: Brother Kogyo Kabushiki Kaisha, Nagoya (JP)

(72) Inventor: Kunihiko Kondo, Handa (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 120 days.

(21) Appl. No.: 13/751,015

(22) Filed: Jan. 25, 2013

(65) Prior Publication Data

US 2013/0195480 A1 Aug. 1, 2013

(30) Foreign Application Priority Data

Jan. 27, 2012 (JP) ..... 2012-015940

(51) Int. Cl.
*G03G 21/00* (2006.01)
*G03G 15/00* (2006.01)
*G03G 15/02* (2006.01)

(52) U.S. Cl.
CPC ..... *G03G 15/55* (2013.01); *G03G 15/0258* (2013.01)
USPC ..... 399/34; 399/31; 399/44; 399/50; 399/71; 399/100; 399/168

(58) Field of Classification Search
USPC ..... 399/31, 34, 44, 50, 71, 100, 168
See application file for complete search history.

(56) References Cited

U.S. PATENT DOCUMENTS 5,572,295 A 11/1996 Sakagami et al.
2007/0147858 A1 * 6/2007 Inukai ..... 399/31
2009/0010661 A1 * 1/2009 Hamaya ..... 399/37
2010/0080593 A1 * 4/2010 Inukai et al. ..... 399/50
2010/0247126 A1 * 9/2010 Naganawa ..... 399/50
2012/0027437 A1 2/2012 Maruyama et al.
2012/0128382 A1 5/2012 Kondo et al.

FOREIGN PATENT DOCUMENTS

JP H03-142483 A 6/1991
JP H04-003178 A 1/1992
JP H04-021875 A 1/1992
JP H05-323773 A 12/1993
JP H06-337600 A 12/1994
JP H07-020686 A 1/1995
JP H07-244420 A 9/1995
JP H11-133765 A 5/1999
JP H11-167241 A 6/1999
JP 2007-086229 A 4/2007
JP 2012-032532 A 2/2012
JP 2012-113117 A 6/2012
JP 2012-113118 A 6/2012

* cited by examiner

*Primary Examiner* — Ryan Walsh
(74) *Attorney, Agent, or Firm* — Merchant & Gould PC

(57) ABSTRACT

A reference value of an electric current flowing through each charging member is determined and recorded in a memory unit at a predetermined time by a reference value recording unit. A voltage application unit is caused to start applying a voltage to the charging members upon startup of an image forming apparatus, and a measurement value of an electric current flowing through each charging member is determined by a measurement unit. A charging member of which the measurement value is such that an absolute value of a difference between the reference value and the measurement value is not smaller than a predetermined value is marked by a determination unit. If there is at least one marked charging member and at least one not-marked charging member, a notification produced by a messaging unit is given through a notification unit.

7 Claims, 5 Drawing Sheets

IMAGE FORMING APPARATUS

CROSS-REFERENCE TO RELATED APPLICATION(S)

This application claims priority from Japanese Patent Application No. 2012-015940 filed on Jan. 27, 2012, the disclosure of which is incorporated herein by reference in its entirety.

FIELD

Apparatuses consistent with one or more aspects of the present invention relate to an image forming apparatus comprising a plurality of charging members configured to charge a plurality of photoconductors, respectively, by a corona discharge.

BACKGROUND

To reduce costs, the image forming apparatus may be configured such that the plurality of charging members are connected in parallel to a single common power source.

In such a configuration, adhesion of silica to one charging member causes the charging member to possess a higher resistance which in turn causes an amount of an electric current allowed to pass through the charging member to decrease, and would at worst, make the charging member unable to properly charge the corresponding photoconductor drum. To avoid this risk, the total amount of electric current obtained by summing up the amounts of electric current flowing through all the charging members may be monitored for use in regulation of a voltage applied to the charging members so that the total amount of electric current is maintained at a predetermined value. This method is considered to suppress poor charging performance.

Excessive adhesion of silica to one charging member which raises the resistance of that charging member would result in excessive increase in the amount of electric current passing through the other charging member(s), as the case may be. Therefore, a user may have to be notified of the necessity of cleaning the relevant charging member(s) not later than the amount of electric current passing through that charging member(s) reaches an upper limit thereof.

However, the aforementioned total current amount monitoring scheme typically does not provide a user with information as to which charging member is in need of cleaning, and the user would possibly choose to clean only one charging member and forget cleaning other charging member(s) in need of cleaning. If the charging member which the user has forgotten and failed to clean is the most seriously contaminated one (i.e., with more silica adhered), the next printing operation would soon be aborted by an error because the amount of electric current would reach its upper limit.

SUMMARY

It is one aspect of the present invention to provide an image forming apparatus which has a capability of notifying a user of information as to which charging member is in need of cleaning.

More specifically, in one or more embodiments, an image forming apparatus is provided which comprises a set of photoconductors, a set of charging members each of which is configured to charge a corresponding photoconductor by a corona discharge, a voltage application unit to which the charging members are connected in parallel and which is configured to apply a voltage to the charging members, and a controller configured to exercise control over the voltage application unit, to maintain an amount of an electric current found to be smallest among those of electric currents passing through the charging members at a predetermined value. This controller comprises a reference value recording unit, a measurement unit, a determination unit, and a messaging unit. The reference value recording unit is configured to determine and record a reference value for each charging member in a memory unit at a predetermined time in a printing control process. This reference value is an amount of an electric current flowing through each charging member at the predetermined time. The measurement unit is configured to cause the voltage application unit to start applying a voltage to the charging members upon startup of the image forming apparatus, to determine a measurement value for each charging member. This measurement value is an amount of an electric current flowing through each charging member. The determination unit is configured to mark a charging member of which the measurement value is such that an absolute value of a difference between the reference value recorded for the charging member in the memory unit and the measurement value determined by the measurement unit for the charging member is not smaller than a predetermined value, as a charging member which has been subjected to cleaning. The messaging unit is configured to produce a notification if there is are one or more charging members marked by the determination unit and one or more charging members not marked by the determination unit in the set of charging members. This notification is given through a notification unit to advise a user that there is at least one charging member in need of cleaning.

BRIEF DESCRIPTION OF THE DRAWINGS

The above and other aspects, various embodiments, their advantages and further features of the present invention will become more apparent by describing in detail illustrative, non-limiting embodiments thereof with reference to the accompanying drawings, in which.

DESCRIPTION OF EMBODIMENTS

Figure 1:
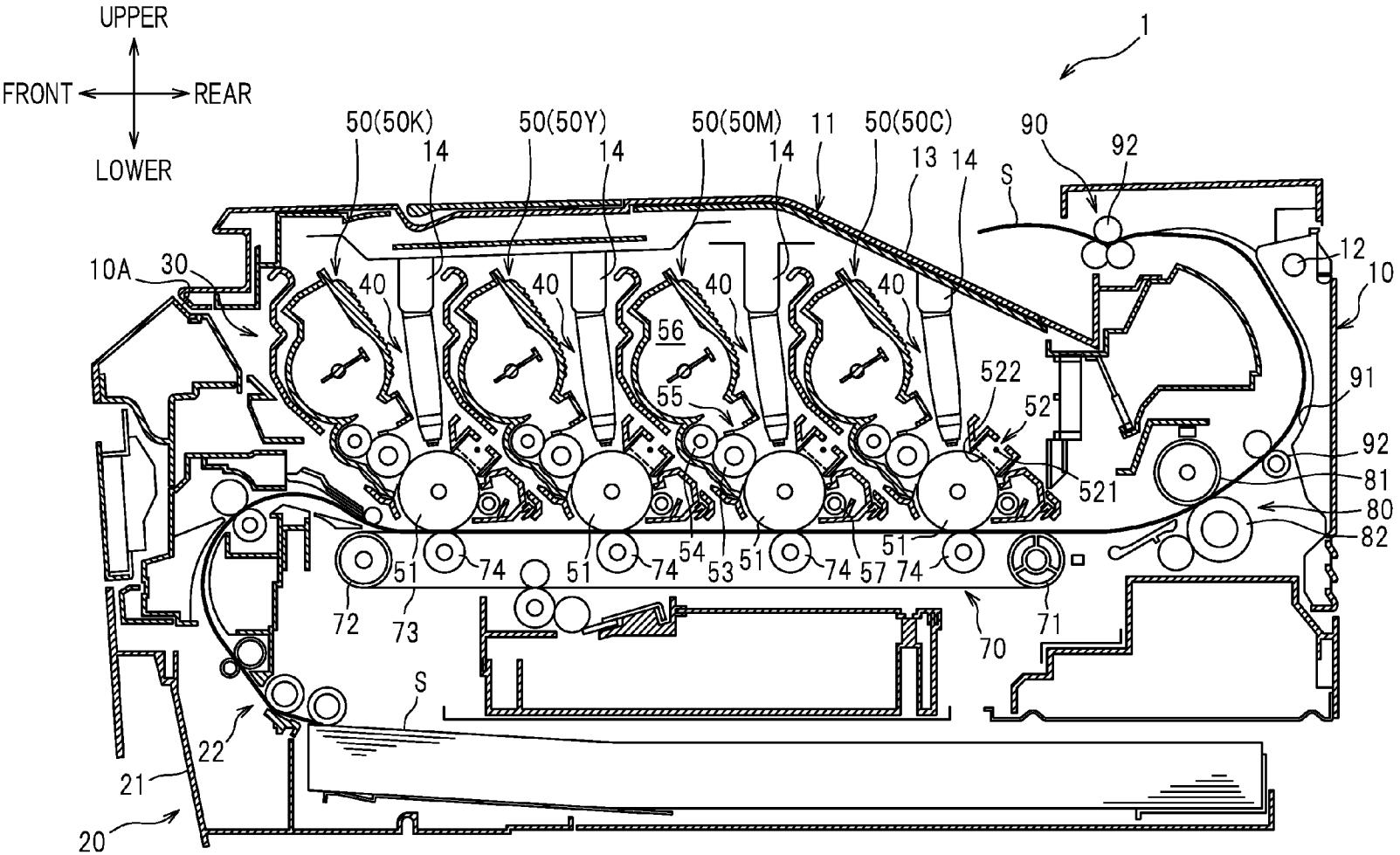
FIG. 1 is a schematic sectional view of a color printer as an example of an image forming apparatus according to an illustrative embodiment of the present invention.

A detailed description will be given of illustrative, non-limiting embodiments of the present invention with reference made to the drawings where appropriate. In the following description, a general setup of a color printer according to one embodiment of the present invention will be described briefly at the outset, and then detailed features of the color printer 1 will be described in detail.

Hereinbelow, in describing the arrangement and operation of each component in the color printer 1, the direction is designated as from the viewpoint of a user who is using (operating) the color printer 1. To be more specific, in FIG. 1, the left-hand side of the drawing sheet corresponds to the "front" side of the printer, the right-hand side of the drawing sheet corresponds to the "rear" side of the printer, the front side of the drawing sheet corresponds to the "right" side of the printer, and the back side of the drawing sheet corresponds to the "left" side of the printer. Similarly, the direction of a line extending from top to bottom of the drawing sheet corresponds to the "vertical" or "up/down (upper/lower or top/bottom)" direction of the printer.

<General Setup of Color Printer>

As shown in FIG. 1, the color printer 1 comprises a main body housing 10, an upper cover 11 as an example of a cover, a sheet feeder unit 20 for feeding a sheet S (e.g., of paper) in the main body housing 10, an image forming unit 30 for forming an image on the sheet S fed by the sheet feeder unit 20, and a sheet output unit 90 for ejecting the sheet S on which an image is formed, to an outside of the main body housing 10.

The upper cover 11 is provided at a top side of the main body housing 10, and configured to be swingable on a pivot 12 located at a rear end thereof (i.e., a front end thereof movable upward and downward) relative to the main body housing 10 to accordingly open and close an opening 10A provided at the top side of the main body housing 10. The opening 10A is an opening provided to render the inside of the main body housing 10 accessible for maintenance of several components installed inside the main body housing 10.

Maintenance of several components of the color printer 1 installed inside the main body housing 10 may include replacement of a process unit 50 (a charger 52 therein) which will be described later by a new one, and cleaning of a charger 52 (a wire electrode 521 thereof). A specific method or structure for cleaning of the charger 52 is known in the art, and thus not detailed herein.

The sheet feeder unit 20 is provided in a bottom space within the main body housing 10, and mainly includes a sheet feed tray 21 configured to store sheets S therein, and a sheet feed mechanism 22 configured to feed a sheet S from the sheet feed tray 21 to the image forming unit 30. Sheets S in the sheet feed tray 21 are separated (uppermost one separated from others) and forwarded one by one to the image forming unit 30 by the sheet feed mechanism 22.

The image forming unit 30 mainly includes four LED units 40, four process units 50 as an example of image forming units, a transfer unit 70, and a fixing unit 80.

The LED units 40 are swingably supported by the upper cover 11. To be more specific, the upper cover 11 includes four holding portions 14 and each LED unit 40 is supported swingably on the holding portion 14 of the upper cover 11. When the upper cover 11 is in a closed position, each LED unit 40 is disposed opposite to an upper surface of a corresponding photoconductor drum 51. Each LED unit 40 includes a light-emitting part (an array of light-emitting diodes) disposed at a distal end thereof and configured to selectively emit light in accordance with image data, no that a uniformly charged peripheral surface of the corresponding photoconductor drum 51 is exposed to light.

The process units 50 are disposed between the upper cover 11 and the sheet feed tray 21, and arranged in tandem in a front-rear direction. Each process unit 50 is configured to be detachable and installable (replaceable) in a substantially upward-downward direction from and in the main body housing 10 through the opening 10A of the main body housing 10 which becomes available (making the inside of the main body housing 10 accessible) when the upper cover 11 is swung open.

Each process unit 50 includes a photoconductor drum 51 as an example of a photoconductor, a charger 52, a development roller 53, a supply roller 54, a doctor blade 55, a toner reservoir 56, and a cleaning roller 57. The toner reservoir 56 is configured to store positively chargeable toner which is one example of developer.

The process units 50 are comprised of four process units 50K, 50Y, 50M, 50C for different colors, storing toner of black, yellow, magenta, and cyan, respectively, which are arranged in this sequence from an upstream of a direction of conveyance of a sheet S. In the following description and drawings, each component (i.e., photoconductor drum 51, charger 52, development roller 53, cleaning roller 57) in a specific process unit 50 will be specified by its color, and designated by appending the corresponding suffix K, Y, M or C to the reference numerals (e.g., a charger 52C in a process unit 50C), where appropriate.

Figure 2:
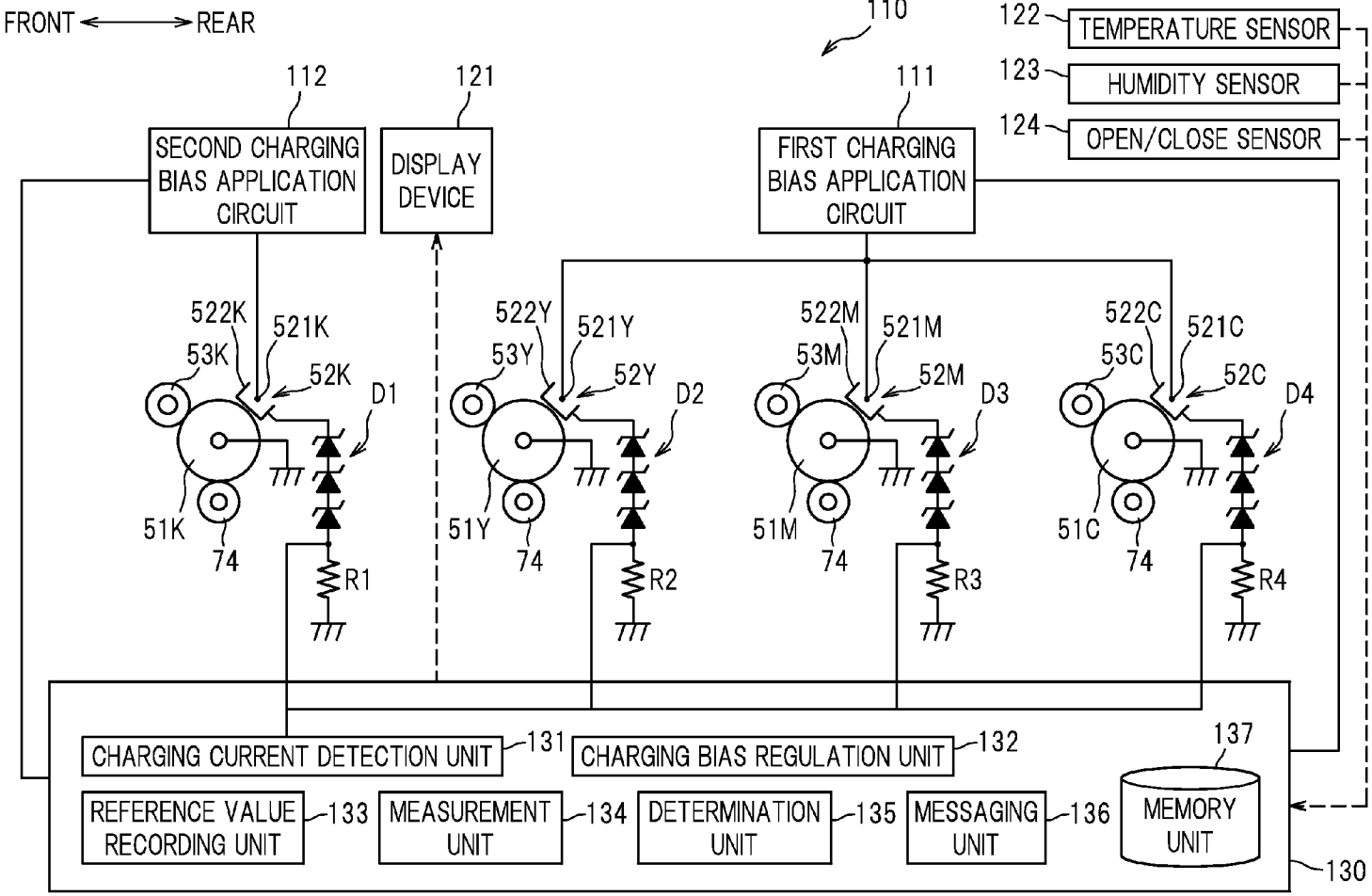
FIG. 2 is a schematic diagram showing chargers and associated systems and elements.

The photoconductor drum 51 is a known photoconductor including a cylindrical drum body possessing an electrical conductivity, a photoconductive (or photosensitive) layer formed on a peripheral surface of the drum body, and a shaft electrically connected to the drum body. The shaft of the photoconductor drum 51 is grounded as shown in FIG. 2.

The charger 52 is provided for each photoconductor drum 51, and mainly includes a wire electrode 521 as an example of a charging member, and a grid, electrode 522. This charger 52 is configured to generate a corona discharge when a charging bias (voltage) is applied thereto, so that the peripheral surface of a corresponding photoconductor drum 51 is positively charged to a potential greater than a development bias applied to the corresponding development roller 53.

The development roller 53 is provided for each photoconductor drum 51, and configured to carry toner. This development roller 53 is configured to supply toner to a corresponding photoconductor drum 51 when the development roller 53 to which a positive development bias is applied comes in contact with the corresponding photoconductor drum 51, so that a region on the peripheral surface of the photoconductor drum 51 of which a surface potential is lowered to a level smaller than the development bias by exposure is supplied with toner.

The cleaning roller 57 is provided for each photoconductor drum 51, and configured to remove foreign matter (paper powder, toner and the like) from a corresponding photoconductor drum 51 when the cleaning roller 57 comes in contact with the corresponding photoconductor drum 51. To be more specific, during the normal printing operation, a cleaning bias applied to the cleaning roller 57 is smaller than a surface potential of the corresponding photoconductor drum 51.

The transfer unit 71) is disposed between the sheet feed tray 21 and a process unit 50, and mainly includes a driving roller 71, a driven roller 72, an endless conveyor belt 73 looped around the driving roller 71 and the driven roller 72, and four transfer rollers 74. The conveyor belt 73 is disposed with its outer surface kept in contact with the peripheral surfaces of the photoconductor drums 51, and the transfer rollers 74 are disposed at an inner surface of the conveyor belt 73 in positions corresponding to the respective photoconductor drums 51, i.e., such that the conveyor belt 73 is held between each transfer roller 74 and the corresponding photoconductor drum 51.

The fixing unit 80 is disposed rearwardly of the process unit 50 and the transfer unit 70, and mainly includes a heating roller 81 and a pressure roller 82 disposed opposite to the heating roller 81 and pressed against the heating roller 81.

In the image forming unit 30, the peripheral surfaces of the photoconductor drums 51 are uniformly charged by the chargers 52, and then exposed to light by the LED units 40, so that an electrostatic latent image formulated for each color based upon the image data is formed on the peripheral surface of each photoconductor drums 51.

Toner in each toner reservoir 56 is supplied through the supply roller 54 to the development roller 53, and (as the development roller 53 rotates) forwarded to pass through an interface between the development roller 53 and the doctor blade 55 so that a thin layer of toner having a predetermined thickness is carried on the development roller 53. In this process, the toner is positively charged by friction between the development roller 53 and the supply roller 54 and between the development roller 53 and the doctor blade 55.

When toner carried on the development roller 53 is supplied to an exposed region on the peripheral surface of the photoconductor drum 51, the electrostatic latent image is visualized, and a toner image is thus formed on the peripheral surface of the photoconductor drum 51. Thereafter, while a sheet S fed from the sheet feeder unit 20 is conveyed through an interface between the photoconductor drum 51 and the conveyor belt 73 (behind which the transfer roller 74 with a transfer bias applied thereto is disposed), the toner image formed on the peripheral surface of the photoconductor drum 51 is transferred onto the sheet S. The sheet S with the transferred toner image carried thereon is conveyed through an interface between the heating roller 81 and the pressure roller 82, so that the toner image is thermally fixed on the sheet S.

In the color printer 1, when a multicolor image is formed on a sheet S, toner images are formed on the peripheral surfaces of the photoconductor drums 51 of all the process units 50, and while the sheet S is conveyed to pass through an interface between each photoconductor drum 51 and the conveyor belt 73, toner images for respective colors are transferred one after another, and superposed one on top of another, onto the sheet S. On the other hand, when a monochrome image is formed on a sheet S using black color toner only, a toner image is formed only on the peripheral surface of the photoconductor drum 51K of the process unit 50K where black toner is stored in the toner reservoir 56, and while the sheet S is conveyed to pass through an interface between the photoconductor drum 51K and the conveyor belt 73, the toner image for black is transferred onto the sheet S.

The sheet output unit 90 mainly includes a sheet output path 91 configured to guide a sheet S conveyed out from the fixing unit 80, and a plurality of conveyor rollers 92 configured to convey the sheet S along the sheet output path 91. A sheet S with a toner image thermally fixed thereon (i.e., sheet S on which an image is formed) is conveyed by the conveyor rollers 92 along the sheet output path 91, ejected out of the main body housing 10, and placed on the sheet output tray 13.

<Detailed Configuration of Color Printer>

As shown in FIG. 2, the color printer 1 further comprises a charging bias application device 110, a display device 121 as an example of a notification unit, a temperature sensor 122, a humidity sensor 123, an open/close sensor 124 and a controller 130.

The charging bias application device 110 mainly includes a first charging bias application circuit 111 as an example of a voltage application unit, a second charging bias application circuit 112, four constant-voltage circuits D1, D2, D3, D4, and four electric-current detectors R1, R2, R3, R4.

The first charging bias application circuit 111 is connected to three wire electrodes 521Y, 521M, 521C arranged in parallel (parallel connection) and thus configured to apply a common charging bias (voltage) to the wire electrodes 521Y, 521M, 521C. The second charging bias application circuit 112 is connected to the wire electrode 521K, and configured to apply a charging bias to this wire electrode 521K.

In the present embodiment, the second charging bias application circuit 112 connected only to the wire electrode 521K is provided separately from the first charging bias application circuit 111 connected to the wire electrodes 521Y, 521M, 521C. Therefore, the charging bias applied to the wire electrode 521K can be regulated independently. A specific configuration of the circuit for applying a charging bias to the wire electrode 521 is known in the art, and a detailed description thereof is omitted herein.

The constant-voltage circuits D1-D4 are each composed of three Zener diodes connected in series, and configured such that the voltage applied to the grid electrode 522 of each charger 52 remains constant. The electric-current detectors R1-R4 are each composed of a resistor of which one end is connected to a corresponding constant-voltage circuit D1, D2, D3 or D4 and the other end is grounded.

The display device 121 is a device, such as a liquid crystal display, which is capable of visually representing textual information. The display device 121 is connected to the controller 130, and configured to receive information from the controller 130 and display the information in the form of text.

The temperature sensor 122 is a sensor configured to detect a temperature inside or outside the main body housing 10. The temperature sensor 122 is provided at an appropriate position of the main body housing 10 and connected to the controller 130.

The humidity sensor 123 is a sensor configured to detect a humidity inside or outside the main body housing 10. The humidity sensor is provided, at an appropriate position of the main body housing 10 and connected to the controller 130.

The open/close sensor 124 is a sensor configured to detect the opening and closing of the upper cover 11. The open close sensor 124 is disposed near the upper cover 11, and connected to the controller 130. To be more specific, for example, a photosensor may be adopted, as the open/close sensor 124.

The controller 130 is composed of several elements (not shown) which include a CPU, a RAM, a ROM, an input/output interface, and others. The controller 130 is configured to exercise control over various components (e.g., charging bias application device 110) of the color printer 1 in accordance with preconfigured programs and the like. This controller 130 comprises a plurality of functional units of which those related to the present invention mainly include a charging current detection unit 131, a charging bias regulation unit 132, a reference value recording unit 133, a measurement unit 134, a determination unit 135, a messaging unit 136, and a memory unit 137.

The charging current detection unit 131 has a function of detecting charging currents flowing through four wire electrodes 521, individually. To be more specific, the charging current detection unit 131 is wired to four points each located on connecting lines between one constant-voltage circuit D1, D2, D3 or D4 and a corresponding electric-current detector R1, R2, R3 or R4, so that the charging current detection unit 131 obtains a voltage in proportion to the magnitude of the charging current of each wire electrode 521 (more precisely, the charging current of each grid electrode 522). With this configuration, the charging current detection unit 131 takes a reading of the obtained voltage, to thereby detect a charging current flowing through each wire electrode 521.

From the charging currents flowing through the four wire electrodes 521 individually detected in the charging current detection unit 131 as described above, the controller 130 can obtain information on the degree of dirt or contamination of each wire electrode 521 (the amount of silica adhered thereto).

The charging bias regulation unit 132 is configured to exercise control, in the printing control process, over the first charging bias application circuit 111 and the charging bias application circuit 112 based upon the detection results of the charging current detection unit 131. The charging bias regulation unit 132 thus has a function of regulating a charging bias applied to each charger 52. To be more specific, the charging bias regulation unit 132 is configured to control the first charging bias application circuit 111 in such a manner that an amount of a charging current found to be the smallest among those of charging currents passing through the three wire electrodes 521Y, 521M, 521C connected in parallel to the first charging bias application circuit 111 is maintained at a predetermined value. The charging bias regulation unit 132 is also configured to control the second charging bias application circuit 112 in such a manner that an amount of a charging current passing through the wire electrode 521K for black exhibits a predetermined value.

The reference value recording unit 133 has a function of determining, and recording in a memory unit 137, a reference value for each of the wire electrodes 521Y, 521M, 521C at each time when the printing control process ends, which reference value is an amount of an electric current flowing through each wire electrode 521Y, 521M or 521C at that time. Thus, three reference values determined for yellow, magenta and cyan are recorded in the memory unit 137.

The "each time when the printing control process ends" may be any one point of time, including: for example, at a time when an image is formed on one sheet S, at a time when a processing for one printing job as instructed in the color printer 1 is completed, at a time when a processing for a set of jobs as instructed in the color printer 1 is completed, or at a time when a printing control process during its execution is forcefully terminated. Namely, the determination and recording of the reference value for each wire electrode 521 may be timed for any predetermined time in the printing control process without limitation; that is, the timing is not necessarily determined to be a time when the printing control process ends. Such "a predetermined time" in the printing control may be a time, for example, when the value of a charging bias applied to each charger 52 changes.

The reference value recording unit 133 also has a function of obtaining values at a time of recording the reference values, and recording the same in the memory unit 137, which values include: a temperature detected by the temperature sensor 122, a humidity detected by the humidity sensor 123, and a charging bias applied by the first charging bias application circuit 111 (this charging bias will hereinafter referred to as "first charging bias").

The measurement unit 134 has a function of causing the first charging bias application circuit 111 to start applying a first charging bias upon startup of the color printer 1, and determining a measurement value of an electric current flowing through each of the three wire electrode 521Y, 521M, 521C connected in parallel, using the charging current detection unit 131. The startup of the color printer 1 is determined based upon a signal sent from the open/close sensor 124 to the controller 130; that is, when the motion of the upper cover 11 from an open position to a closed position is completed, the color printer 1 starts up so that the measurement unit 134 performs its measuring operations. In this way, three measurement values are determined for yellow, magenta and cyan.

To be more specific, the measurement unit 134 is configured to change the charging bias to be applied by the first charging bias application circuit 111 to the wire electrodes 521 upon startup of the color printer 1 to determine the measurement value for each wire electrode 521, from a first voltage which is previously applied (i.e., when the printing control process ends and reference values are recorded, in the present embodiment), to a second voltage of which an absolute value is smaller than that of the first voltage. The measurement unit 134 determines measurement values for yellow, magenta and cyan which are amounts of electric currents flowing through the wire electrodes 521Y, 521M, 521C, respectively, by application of the smaller second voltage by the first charging bias application circuit 111.

With this configuration, for example, even when one or two of the wire electrodes 521 have been subjected to cleaning or replacement before the startup of the color printer 1 and thus have resistances lower than those of the other wire electrode (s) 521 not having undergone cleaning or replacement up to the startup, the risk of an excessive flow of electric current flowing through the one or two wire electrodes 521 can be reduced because the second voltage of which an absolute value is smaller than that of the previously applied first voltage is applied to each wire electrode 521Y, 521M, 521C.

The second voltage used as the first charging bias upon startup may be set appropriately at a predetermined fixed value or a value obtained by calculation using a predetermined formula. Such a fixed value may be, for example, a value smaller than the smallest value of the voltage applied in the printing control process (the value of voltage applied to wire electrodes 521 if they are all new, thus not contaminated and have resistances of their specification values). A value obtained by calculation usable for this purpose may be, for example, a value on the order of 70-80% of the previous value of the first charging bias.

The measurement unit 134 also has a function of obtaining and outputting to the determination unit 135 at a time of determination of the aforementioned measurement values (amounts of electric current), other values which include: a temperature detected by the temperature sensor 122 and a humidity detected by the humidity sensor 123.

The determination unit 135 is configured to correct each reference value based upon the first charging bias obtained at a previous time of ending of the printing control process (when the reference values are recorded by the reference value recording unit 133) and the first charging bias applied this time upon startup of the color printer 1 (when the measurement values are determined by the measurement unit 134), to equalize the conditions on the first charging bias (voltage conditions) applied at the time of ending of the printing control process and at the time of the startup of the color printer 1.

Figure 3:
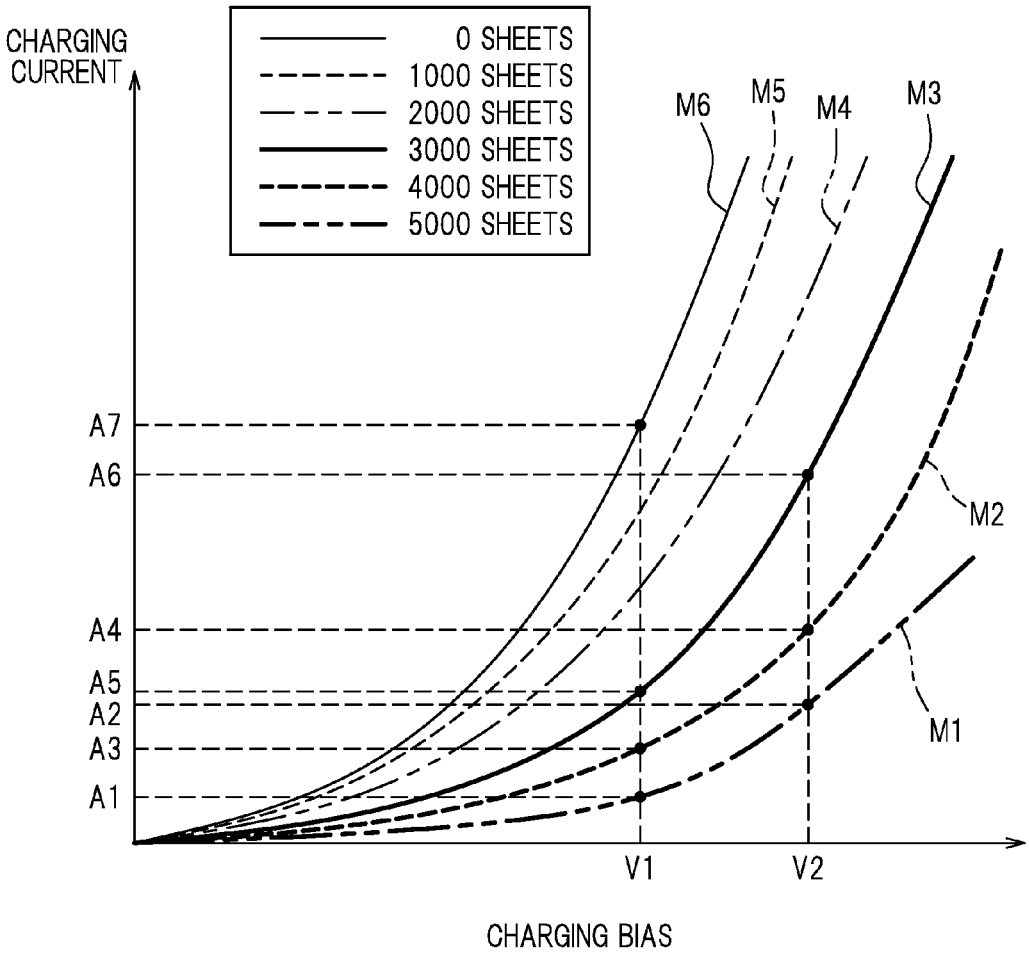
FIG. 3 is a graph showing relationships between charging bias and charging current.

As shown in FIG. 3, the charging bias applied to the wire electrodes 521 and the charging current flowing through each wire electrode 521 are related such that the greater the charging bias, the greater the amounts of charging current. Furthermore, the tendency shown herein is such that the greater the number of times of use of the wire electrode 521 as indicated by the number of sheets printed in the graph becomes (i.e., the more the silica is adhered to the wire electrode 521), the smaller the ratio of the amount of increase in the charging current to the amount of increase in the charging bias (i.e. slope or gradient of the tangent of each curve shown in the graph) becomes.

Maps M1-M6 (graphs) representative of the charging current vs charging bias relationship varying according to the number of times of use of the wire electrode 521 as shown in FIG. 3 is stored in the memory unit 137. The determination unit 135 utilizes these maps M1-M6 to correct each reference value so as to equalize the voltage conditions (first charging bias conditions) applied at the time of ending of the printing control process and at the time of startup of the color printer 1. To be more specific, the determination unit 135 identifies one specific map (e.g., map M1) selected among a plurality of maps M1-M6 based upon the values of the charging current and the first charging bias obtained at the time of ending of the printing control process, and corrects the reference values, at the time of startup of the color printer 1, based upon the map identified at the time of ending of the printing control process and the second voltage (e.g., the predetermined value of the first charging bias to be applied upon startup of the color printer 1).

For example, in a case where a charging bias V2 is applied and a charging current A2 (reference value) is recorded at a time of ending of the printing control process, the map M1 is identified based on these values of the charging bias V2 and the charging current A2. Thereafter, upon startup of the color printer 1, the reference value is corrected from A2 to A1 which is the value on the map M1 corresponding to the charging bias V1 applied upon startup. For example, in a case where the charging bias V2 is applied and a charging current A4 (reference value) is recorded at a time of ending of the printing control process, the map M2 is identified based on these values of the charging bias V2 and the charging current A4. Thereafter, upon startup of the color printer 1, the reference value is corrected from A4 to A3 which is the value on the map M2 corresponding to the charging bias V1 applied upon startup.

The determination unit 135 is also configured to correct each reference value based upon the temperature and the humidity obtained at a previous time of ending of the printing control process the reference values are recorded by the reference value recording unit 133) and the temperature and the humidity detected this time upon startup of the color printer 1 (when the measurement values are determined by the measurement unit 134), to equalize the temperature and humidity conditions applied at the time of ending the printing control process and at the time of the startup of the color printer 1.

Further, the determination unit 135 has a function of making a determination as to whether an absolute value of a difference between the measurement value and the reference value for each wire electrode 521 is not smaller than a predetermined value, and determining that the wire electrode 521 satisfying the condition of the absolute value not smaller than the predetermined value is a wire electrode 521 which has been subjected to cleaning. The predetermined value herein may be any value, but it is preferable that the predetermined value be greater than zero, with consideration given to the measurement error of the charging current.

To be more specific, the determination unit 135 determines that the wire electrode 521Y for yellow has been subjected to cleaning if the absolute value of the difference between the measurement value for yellow and the reference value for yellow is not smaller than the predetermined value. Similarly, the determination unit 135 determines that the wire electrode 521M for magenta has been subjected to cleaning if the absolute value of the difference between the measurement value for magenta and the reference value for magenta is not smaller than the predetermined value, and that the wire electrode 521C for cyan has been subjected to cleaning if the absolute value of the difference between the measurement value for cyan and the reference value for cyan is not smaller than the predetermined value.

In this way, the determination unit 135 can make a determination as to which wire electrode 521 among the wire electrode 521Y, 521M, 521C connected in parallel is a wire electrode which has been subjected to cleaning, and thus a user can be notified of the wire electrode(s) determined by the determination unit 135 as that which is in need of cleaning.

The messaging unit 136 is configured to produce a notification to the effect that all the three wire electrodes 521Y, 521M, 521C should be subjected to cleaning, to give a user the notification through the display device 121, if the determination unit 135 determines that only a subset (one or two) of the set of the three wire electrodes 521Y, 521M, 521C connected in parallel has been subjected to cleaning. That is, the messaging unit 136 is configured to produce a notification, for example, if it is determined that there is one wire electrode 521 which has been subjected to cleaning, to advise a user that all the wire electrodes 521Y, 521M, 521C (including the remaining two wire electrodes 521 not marked as a wire electrode which has been subjected to cleaning) are in need of cleaning.

Next, a detailed description will be given of the process of control exercised by the controller 130, with reference to flowcharts shown in FIGS. 4 and 5. It is to be appreciated that the process of control for cleaning of the wire electrode 521K for black may be carried out by a method known in the art, and thus a detailed description thereof will be omitted herein. In the following description, the discussion will focus on the process of control for cleaning of the three wire electrodes 521Y, 521M, 521C for yellow, magenta and cyan.

Figure 4:
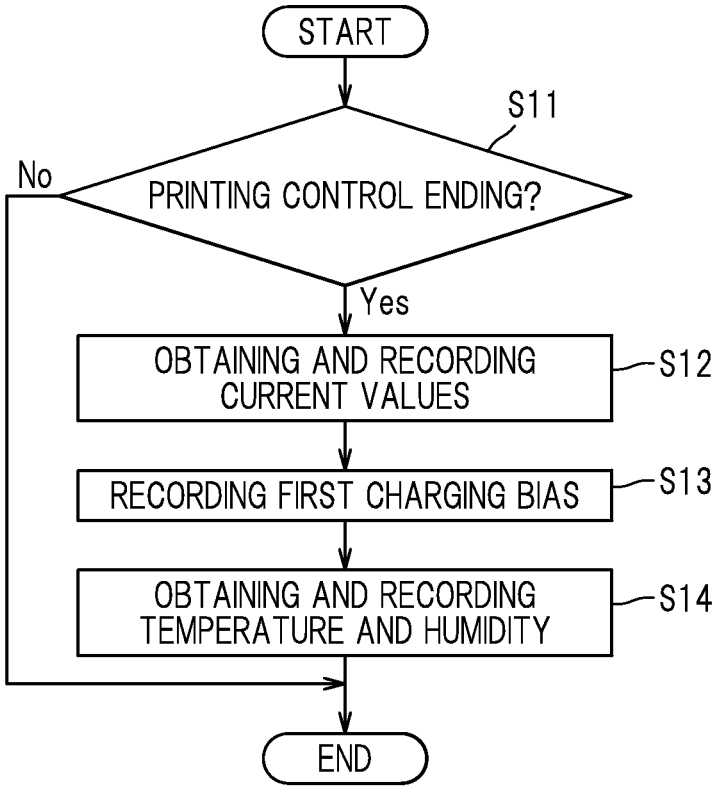
FIG. 4 is a flowchart showing an operation performed by a controller when a printing operation ends.

The controller 130 is configured to repeatedly execute the process shown in the flowchart of FIG. 4 during the normal printing control process. In the control process for cleaning, the controller 130 first determines whether or not the printing control process is coming to an end (S11).

If it is determined in step S11 that the printing control process is coming to an end (Yes), then the controller 130 obtains, from the electric-current detectors R2-R4, values (amounts) of charging currents flowing through the three wire electrodes 521Y, 521M, 521C (except the wire electrode 521K for black), respectively, at a time of ending of the printing control process, and recording the obtained values as reference values for the wire electrodes 521Y, 521M, 521C in the memory unit 137 (S12). To be more specific, for example, as shown in FIG. 3, if the degrees of contamination of the three wire electrodes 521Y, 521M, 521C at the time of ending of the printing control process are those such as represented in the maps M1, M2, M3, respectively, and the first charging bias is V2, then the values of the charging currents flowing through the wire electrodes 521Y, 521M, 521C are A2, A4, A6, respectively. Therefore, A2 is recorded as the reference value for yellow, A4 is recorded as the reference value for magenta, and A6 is recorded as the reference value for cyan.

After step S12, the controller 130 records the first charging bias (e.g., V2) applied at the time of ending of the printing control process in the memory unit 137 (S13). After step S13, the controller 130 obtains the temperatures and humidities at the time of ending of the printing control process from the temperature sensor 122 and the humidity sensor 123, and records these temperatures and the humidities in the memory unit 137 (S14).

After step S14 and if it is determined that the printing control process is not coming to an end (No in step S11), then the controller 130 brings this control process to an end. In this embodiment, the control process steps S12, S13, S14 are executed in this sequence, but the present invention is not limited to this specific sequence. The sequence (order) of the steps S12, S13, S14 may be altered as appropriate. The execution of the process steps S12, S13, S14 may be timed not only at the time of ending of the printing control process, but also at any other time, that is, at a predetermined time in the printing control process.

Figure 5:
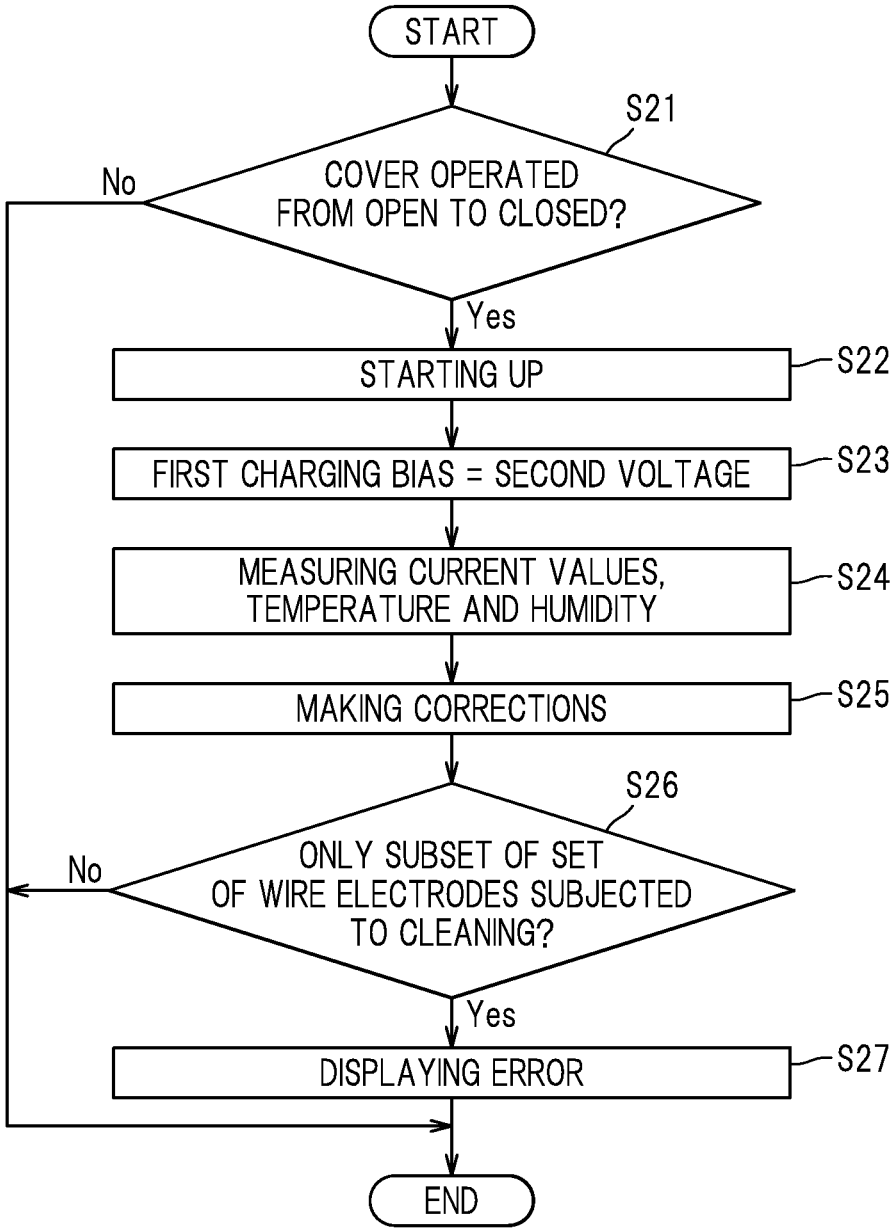
FIG. 5 is a flowchart showing an operation performed by the controller upon startup of the color printer.

The controller 130 is further configured to repeatedly execute the process shown in the flowchart of FIG. 5, when the normal printing control process is not executed. In this control process, the controller 130 first determines whether or not the upper cover 11 is operated to shift from the open state to the closed state (S21). If the controller 130 determines in step S21 that the upper cover 11 is operated to shift from the open state to the closed state (Yes), then the controller 130 causes the color printer 1 to start up (S22).

Hereupon, the "start up" refers to the start of preliminary operation for making the color printer ready for the normal printing control process. For example, the startup includes preparation for the control over the fixing unit 80 in which heating of the heating roller 81 is started, and preparation for the control over the process unit in which rotation of the agitator (designation with reference numeral omitted) in the toner reservoir 56 is started to start agitating toner therein.

After step S22, the controller 130 changes the first charging bias to the second voltage (smaller than a previously applied voltage), and applies this first charging bias to the wire electrodes 521Y, 521M, 521C (S23). After step S23, the controller 130 then determines measurement values of the charging currents flowing through the respective wire electrodes 521Y, 521M, 521C, and obtains the measurements of temperature and humidity from the temperature sensor 122 and the humidity sensor 123 (S24).

After step S24, the controller 130 corrects the reference values stored in the memory unit 137 based upon the first charging biases recorded at the time of ending of the printing control process and the first charging biases obtained at the time of startup of the color printer 1, respectively, as well as the temperature and humidity obtained from the temperature sensor 122 and the humidity sensor 123 (S25). To be more specific, the controller 130 identifies maps M1-M3 for the respective wire electrodes 521Y, 521M, 521C from the reference values A2, A4, A6 recorded in the memory unit 137 and the first charging bias V2, and corrects the reference values from A2, A4, A6 to A1, A3, A5 corresponding to the first charging bias V1, respectively, using the maps M1-M3, and further corrects these reference values A1, A3, A5 based upon the to temperature and the humidity.

After step S25, the controller 130 determines whether only a subset (one or two) of the set of the three wire electrodes 521Y, 521M, 521C has been subjected to cleaning, by comparing the measurement values with the corrected reference values (S26).

Supposing that only the wire electrode 521M for magenta corresponding to the map M2 has been subjected to cleaning, the wire electrode 521M contaminated to an extent corresponding to the map M2 is changed to a state corresponding to the map M6. Accordingly, in this instance, the measurement value obtained by application of the first charging bias V1 to the wire electrode 521M for magenta upon startup of the color printer 1 takes on the value A7 that is on the map M6, and thus the difference between the value A7 and the corrected reference value A3 is confirmed to be not smaller than the predetermined value. Consequently, it is determined that the wire electrode 521M has been subjected to cleaning.

Supposing that the wire electrode 521M for magenta has not been subjected to cleaning, the wire electrode 521, at the time of the startup of the color printer 1, remains contaminated to the extent corresponding to the map M2. Accordingly, the measurement value takes on the value A3 that is on the map M2. Therefore, in this instance, the difference between the value A3 and the corrected reference value A3 is confirmed to be a value (substantially equal to zero) smaller than the predetermined value. Consequently, it is determined that the wire electrode 521M has not been subjected to cleaning.

If the controller 130 determines in step S26 that only a subset of the set of three wire electrodes 521 has been subjected to cleaning (Yes), then an error message to the effect that the three wire electrodes 521Y, 521M, 521C should be subjected to cleaning is produced and given to a user through the display device 121 (S27). After step S27, and when the controller 130 determines "No" in step S21 or in step S26, then the controller 130 brings this control process to an end.

According to the present embodiment, in addition to the effects described above, the following advantages can be achieved.

Change or deviation in the electric-current values due to temperature and humidity changes can be substantially compensated for, and its influence on the determination results can be considerably reduced, by making temperature and humidity corrections as described above. As a result, the determination as to whether any of the wire electrodes 521 is in need of cleaning can be made with improved accuracy.

Since an error message is produced and given to a user through the display device 121 which is configured to visually represent textual information, the information for example on the wire electrode(s) 521 in need of cleaning can be conveyed effectively and more accurately in comparison with an alternative configuration in which a user is notified of the same information by voice or sound.

Since the start up of the color printer as a trigger for the control process for cleaning takes place in response to the open/close operation of the upper cover 11 which is performed every time when any wire electrode(s) 521 is subjected to cleaning, the electric-current values obtained immediately after the wire electrode 521 if any is subjected to cleaning can be used for determination of the measurement value. Therefore, the determination as to whether or not any of the wire electrodes 521 has been subjected to cleaning can be made with increased accuracy.

The present invention is not limited to the illustrative embodiment as described above, but can be utilized in various other forms as will be exemplified hereinbelow. In the following description, the same elements having the same constructions as those of the above-described embodiment are designated by the same reference numerals, and a duplicate description thereof will be omitted.

In the above-described embodiment, when it is determined that a subset of the set of three wire electrodes 521Y, 521M, 521C connected in parallel has been subjected to cleaning, the notification to the effect that all the three wire electrodes 521Y, 521M, 521C should be in need of cleaning is produced and given to a user, but the present invention is not limited to this specific configuration. For example, an alternative configuration may be feasible such that a notification produced when it is determined that a subset of the set of three wire electrodes 521Y, 521M, 521C connected in parallel has been subjected to cleaning is to the effect that the remaining wire electrode(s) which has not been subjected to cleaning should be in need of cleaning, or to the effect that all the wire electrodes in the image forming apparatus including any wire electrode not connected in parallel thereto should be in need of cleaning.

In the above-described embodiment, the reference values are corrected, but the present invention is not limited to this specific configuration; the measurement values may be corrected, instead.

In the above-described embodiment, the process unit 50 comprising a development cartridge (designation with reference numeral is omitted) including the development roller 53 and a drum cartridge (designation with reference numeral is omitted) including the photoconductor drum 51 which cartridges are discretely provided (see FIG. 1) is adopted as an image forming unit by way of example, but the present invention is not limited to this configuration. Alternatively, the image forming unit provided in the image forming apparatus consistent with the present invention may be configured to comprise an integral cartridge which includes both of a development roller and a photoconductor drum and thus have functions of the development cartridge and the drum cartridge.

In the above-described embodiment, the control process (particularly, its measurement and determination steps) related to the present invention is configured to be executed upon startup of the color printer 1 (image forming apparatus) after the open/close operation of the upper cover 11, but the present invention is not limited to this specific configuration. For example, the control process related to the present invention may be configured to be executed upon startup of the image forming apparatus after the power switch is turned on.

In the above-described embodiment, the display device 121 is adopted as an example of a notification unit of the present invention, but the present invention is not limited to this example. Alternatively, a device configured to represent information by voice or any other type of notification unit may be adopted instead.

In the above-described embodiment, the upper cover is adopted as an example of a cover of the present invention, but the present invention is not limited to this example. Alternatively, a front cover or a side cover may be provided instead and configured in a manner consistent with the present invention.

In the above-described embodiment, developer adopted is positively chargeable toner is used by way of example, but developer usable in an image forming apparatus consistent with the present invention is not limited thereto. Negatively chargeable toner may be used instead. In this alternative configuration, the sign of the voltage may be reversed.

In the above-described embodiment, the photoconductor drum 51 is illustrated by way of example, but the present invention is not limited to this specific configuration. For example, a belt-type photoconductor may be used in an image forming apparatus configured in accordance with the present invention.

In the above-described embodiment, the wire electrodes 521 are adopted as charging members, but the present invention is not limited thereto. Members not having the shape of wire may be used instead.

In the above-described embodiment, the present invention is applied to the color printer 1, but the present invention is not limited thereto. Any other type of image forming apparatus such as a photocopier, a multifunction peripheral, etc. may be configured in accordance with the present invention.

In the above-described embodiment, the wire electrode 521K for black is arranged independent of the other three wire electrodes 521Y, 521M, 521C for yellow, magenta, cyan, and a separate power source (i.e., second charging bias application circuit 112) is provided for the wire electrode 521K, while a common power source (i.e., first charging bias application circuit 111) is provided for the wire electrodes 521Y, 521M, 521C. However, the present invention is not limited to this specific configuration; for example, a image forming apparatus including only one common power source for all the wire electrodes which are connected in parallel to this common power source may be implemented in accordance with the present invention.

In the above-described embodiment, one voltage application unit (charging bias application circuit 111) is provided as a common power source for three charging members for yellow, magenta and cyan (wire electrodes 521Y, 521M, 521C), but the present invention is not limited to this configuration, and two of three charging members may be connected in parallel to on common voltage application unit, while the other one charging member may be connected to another voltage application unit. For example, two charging members for magenta and cyan only may be connected in parallel to a common voltage application unit (i.e., the other charging member for yellow is not connected to this common voltage application unit and connected independently to another voltage application unit).

In the above-described embodiment, the color printer 1 using toner of four different colors and thus comprising four image forming units for respective colors, but the present invention is not limited to this specific configuration: that is, the image forming apparatus consistent with the present invention may comprise three image forming units for three colors, or two image forming units for two colors. In any cases, at least one set of charging members are arranged in parallel and connected to a common voltage application unit, so that the present invention may be applied thereto.

What is claimed is:

1. An image forming apparatus comprising:

a set of photoconductors;

a set of charging members each of which is configured to charge a corresponding photoconductor by a corona discharge;

a voltage application unit to which the set of charging members are connected in parallel and which is configured to apply a voltage to the charging members; and a controller configured to exercise control over the voltage application unit, to maintain an amount of an electric current found to be smallest among those of electric currents passing through the charging members at a predetermined value, the controller comprising:

a reference value recording unit configured to determine and record a reference value for each charging member in a memory unit at a predetermined time in a printing control process, the reference value being an amount of an electric current flowing through each charging member at the predetermined time;

a measurement unit configured to cause the voltage application unit to start applying a voltage to the charging members upon startup of the image forming apparatus, to determine a measurement value for each charging member, the measurement value being an amount of an electric current flowing through each charging member;

a determination unit configured to mark a charging member of which the measurement value is such that an absolute value of a difference between the reference value recorded for the charging member in the memory unit and the measurement value determined by the measurement unit for the charging member is not smaller than a predetermined value, as a charging member which has been subjected to cleaning; and a messaging unit configured to produce a notification if there are one or more charging members marked by the determination unit and one or more charging members not marked by the determination unit in the set of charging members, the notification being given through a notification unit to advise a user that there is at least one charging member in need of cleaning.

2. The image forming apparatus according to claim 1, wherein the notification produced by the messaging unit and given to a user through the notification unit includes information as to which charging member is in need of cleaning.

3. The image forming apparatus according to claim 1, wherein the measurement unit is further configured to change the voltage to be applied by the voltage application unit to the charging members to determine the measurement value for each charging member, from a previously applied first voltage to a second voltage of which an absolute value is smaller than that of the first voltage, the measurement value being an amount of an electric current flowing through each charging member when the voltage application unit applies the second voltage to the charging members, and the controller is configured to correct each measurement value or each reference value for use in the determination unit, based upon the first and second voltages, to equalize voltage conditions applied at a time of determination of the measurement value made by the measurement unit and at a time of recording of the reference value made by the reference value recording unit.

4. The image forming apparatus according to claim 1, further comprising a temperature sensor configured to detect a temperature, wherein the controller is configured to correct each measurement value or each reference value for use in the determination unit, based upon the temperature detected by the temperature sensor, to equalize temperature conditions applied at a time of determination of the measurement value made by the measurement unit and at a time of recording of the reference value made by the reference value recording unit.

5. The image forming apparatus according to claim 1, further comprising a humidity sensor configured to detect a humidity, wherein the controller is configured to correct each measurement value or each reference value for use in the determination unit, based upon the humidity detected by the humidity sensor, to equalize humidity conditions applied at a time of determination of the measurement value made by the measurement unit and at a time of recording of the reference value made by the reference value recording unit.

6. The image forming apparatus according to claim 1, wherein the notification unit includes a display device configured to visually represent textual information.

7. The image forming apparatus according to claim 1, further comprising:

main body housing having an opening;

a cover provided at the main body housing to openably close the opening; and a plurality of image forming units each accommodating a corresponding photoconductor and a corresponding charging member, each image forming unit being removably installable inside the main body housing through the opening of the main body housing, wherein the startup of the image forming apparatus which serves as a trigger for starting applying a voltage to the charging members to determine the measurement value is timed to occur when the cover is closed.

* * * * *